US009688089B2

(12) United States Patent
Taki

(10) Patent No.: US 9,688,089 B2
(45) Date of Patent: Jun. 27, 2017

(54) SHEET GLUE BINDING PROCESSING APPARATUS

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Hiroyuki Taki, Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 66 days.

(21) Appl. No.: 14/619,366

(22) Filed: Feb. 11, 2015

(65) Prior Publication Data

US 2016/0229164 A1 Aug. 11, 2016

(51) Int. Cl.

| | |
|---|---|
| ***B42C 9/00*** | (2006.01) |
| ***B65H 37/02*** | (2006.01) |
| ***G03G 15/00*** | (2006.01) |

(52) U.S. Cl.

CPC ..... *B42C 9/0075* (2013.01); *B65H 37/02* (2013.01); *G03G 15/6544* (2013.01); *B65H 2301/4213* (2013.01); *B65H 2301/5113* (2013.01); *B65H 2801/27* (2013.01); *G03G 2215/00818* (2013.01); *G03G 2215/00822* (2013.01); *G03G 2215/00827* (2013.01); *G03G 2215/00877* (2013.01)

(58) Field of Classification Search

CPC ..... B32B 37/12; B32B 37/14; B32B 41/00; B41F 27/1275; B42C 9/00; B42C 9/0006; B42C 9/0018; B42C 9/0025; B42C 9/0031; B42C 9/0037; B42C 9/0056; B42C 9/0062; B42C 9/0075; B42C 9/0081; B42C 9/0087

USPC ..... 156/350, 361; 270/52.18, 58.07, 58.08, 270/58.09; 271/33; 412/8, 37, 901

See application file for complete search history.

(56) References Cited

U.S. PATENT DOCUMENTS

| | | | | |
|---|---|---|---|---|
| 5,899,649 | A * | 5/1999 | Kohtani | B42C 9/0075 412/11 |
| 2013/0036886 | A1* | 2/2013 | Kato | B65H 7/10 83/73 |
| 2013/0113154 | A1* | 5/2013 | Furuhashi | B65H 37/04 270/58.08 |
| 2015/0063953 | A1 | 3/2015 | Taguchi et al. | |

FOREIGN PATENT DOCUMENTS

| | | |
|---|---|---|
| JP | 2009-202485 | 9/2009 |

* cited by examiner

*Primary Examiner* — George Koch

(74) *Attorney, Agent, or Firm* — Amin, Turocy & Watson LLP

(57) ABSTRACT

In accordance with an embodiment, a sheet glue binding processing apparatus comprises a processing tray, a glue binding section and a sheet detection section. The processing tray is used to stack a sheet in such a manner that the end of the binding margin side of the sheet is fed to a positioning section. The glue binding section is configured at the positioning section side of the processing tray to adhere glue material to the binding margin of the sheet already stacked on the processing tray. The sheet detection section detects whether or not the binding margin of the first sheet to be stacked on the processing tray is located at a specific position of the processing tray.

9 Claims, 10 Drawing Sheets

SHEET GLUE BINDING PROCESSING APPARATUS

FIELD

Embodiments described herein relate generally to a technology for detecting whether or not a first sheet to be bound with glue is placed at the correct gluing position of a processing tray.

BACKGROUND

Conventionally, there is known a sheet post processing apparatus which is attached to an image forming apparatus and sequentially receives the sheet discharged from the image forming apparatus and then carries out a sheet post processing. There is a glue binding processing apparatus which has one of the functions of the sheet post processing apparatus to bind a plurality of sheets with glue into one bundle.

The glue binding processing apparatus carries out a processing in which the sequentially received sheets are discharged to and stacked on the processing tray, glue (liquid glue, solid glue, tape glue and the like) is adhered to the part equivalent to a given binding margin of the sheet placed on the processing tray, and then a next sheet is to be placed thereon. In the end, the sheet of the last page is placed on the previous sheet, and in this way, the glue binding is ended.

The glue binding processing apparatus is provided with a cradle that receives a pressing force at the back side of the sheet when glue material is adhered to the sheet so that glue can be adhered to the sheet with sufficient pressing force.

Further, glue is adhered to the sheet at a timing matching with a given timing when the sheet is received from the image forming apparatus.

On the other hand, in a case in which the first sheet to be sent to the processing tray doesn't reach the position of the processing tray where glue is adhered, or in a case in which the corner of the sheet is folded and there is no binding margin part on the cradle, if the operation for adhering glue is executed, the glue is directly adhered to the surface of the cradle.

If the glue is adhered to the surface of the cradle, there is a possibility that a second sheet is stuck to the cradle and the sheet bundle may not be generated. Further, the second sheet may be stuck to the cradle and a paper jam (JAM) may occur.

DETAILED DESCRIPTION

In accordance with one embodiment, a sheet glue binding processing apparatus comprises a processing tray, a glue binding section and a sheet detection section. The processing tray is used to stack a sheet in such a manner that the end of the binding margin side of the sheet is fed to a positioning section. The glue binding section is configured at the positioning section side of the processing tray to adhere glue material to the binding margin of the sheet already stacked on the processing tray. The sheet detection section detects whether or not the binding margin of the first sheet to be stacked on the processing tray is located at a specific position of the processing tray.

Hereinafter, a glue binding processing apparatus according to the present embodiment is described in detail with reference to the accompanying drawings.

Figure 1A:
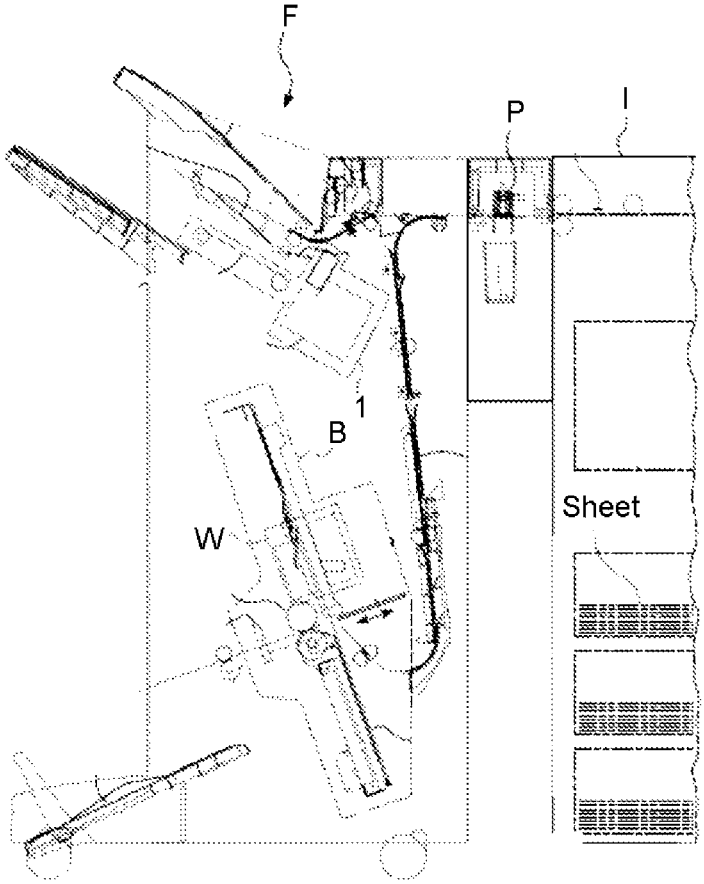
FIG. 1A is a schematic longitudinal section view illustrating a sheet post processing apparatus.
Figure 1B:
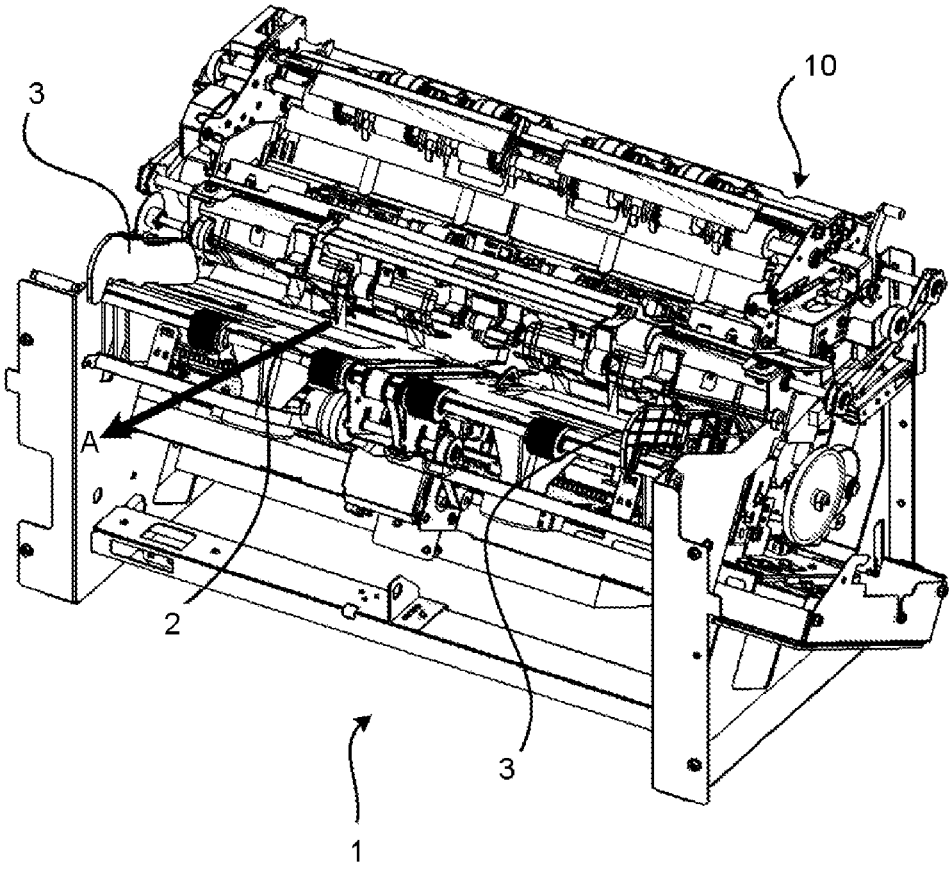
FIG. 1B is a perspective view illustrating a glue binding processing apparatus according to an embodiment.
Figure 2:
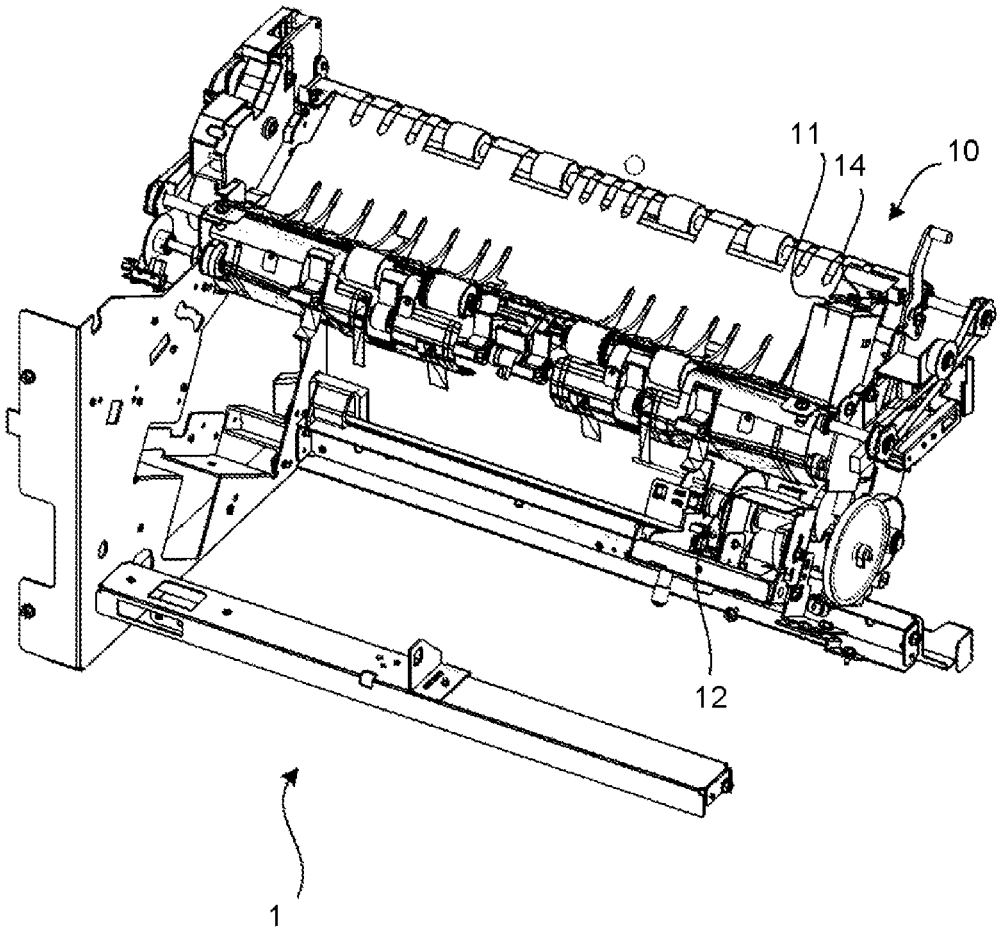
FIG. 2 is a perspective view in which part of FIG. 1 is removed.

FIG. 1A is a schematic longitudinal section view illustrating a sheet post processing apparatus, FIG. 1B is a perspective view illustrating a glue binding processing apparatus according to the embodiment, and FIG. 2 is a perspective view in which part of FIG. 1 is removed.

In FIG. 1A, a sheet post processing apparatus F, which is attached to an image forming apparatus I, roughly comprises, for example, a glue binding processing apparatus 1, a folding processing section B, a stapler W, a punching section P and the like as processing functions. Herein, as an example, the sheet post processing apparatus F which comprises the glue binding processing apparatus 1, the folding processing section B, the stapler W, the punching section P and the like is exemplified. However, the present invention is not limited to this. As long as it is provided with at least the glue binding processing apparatus 1, the configuration of the sheet post processing apparatus F is not limited.

In FIG. 1B, the glue binding processing apparatus 1 is provided with a gluing section 10 for gluing the top surface of a sheet S to be stacked on a processing tray 2. The sheet S to be stacked on the processing tray 2 is guided by guide members 3 in a width direction orthogonal to a sheet discharge direction A. The opposite side to the sheet discharge direction A is set to a feeding direction of the sheet S. The sheet S on the processing tray 2 of which the side in the same direction as the sheet discharge direction A is set to the front end side of sheet, and the other side is set to the rear end side of sheet.

A bundle of sheets subjected to binding processing on the processing tray 2 is discharged in a direction indicated by an arrow A. The sheet glue binding processing apparatus 1 glues the top surface of the sheet S with the gluing section 10 every time the sheet S is to be stacked on the processing tray 2. However, for example, in a case of desiring to bind a sheet bundle of 10 sheets, the gluing process is not carried out on the top surface of the tenth sheet (the sheet which is the tenth stacked and on the uppermost).

The gluing section 10 includes a glue material supply section 14 that is accommodated in a holder 11 in an exchangeable manner, and a cradle 12 which is fixedly arranged below the holder 11.

Figure 3:
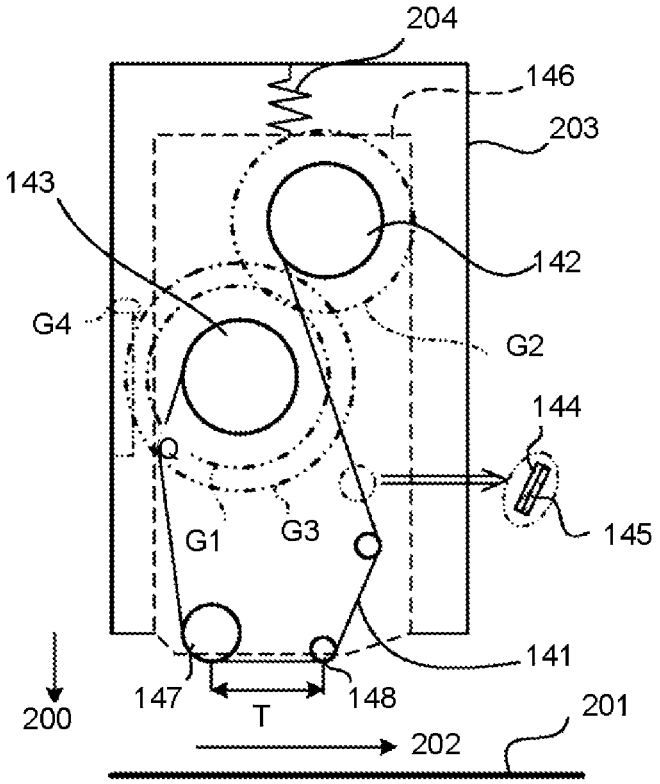
FIG. 3 is a schematic diagram illustrating an example of a glue material supply section formed by tape glue.

The glue material supply section 14 enables the liquid glue, solid glue, tape glue and the like to be adhered to a sheet. An example of the glue material supply section 14 using the tape glue is shown in FIG. 3.

The glue material supply section 14 shown in FIG. 3 takes a pressure-sensitive adhesive tape (hereinafter referred to as an adhesive tape for short) 141 as glue. The adhesive tape 141 is wound into a roll on a feed reel 142, and one end of the adhesive tape 141 is wound on a winding reel 143. In the adhesive tape 141, a transferred glue part 145 for forming glue is adhered to one surface of a roll film 144 in a peelable manner. A transferred glue part 145 having a double-sided adhesiveness of which the part transferred to adherend in transfer area is able to be peeled off from the roll film 144.

The feed reel 142 and the winding reel 143 are rotatably supported by a substrate 146, and are stretched via rollers 147 and 148 that are arranged at the front end of the substrate 146. In a pressing transfer area T having a length between the roller 147 and the roller 148, the substrate 146 is pressed towards the direction indicated by an arrow 200, and the transferred glue part 145 of the adhesive tape 141 is pressed against a transferred surface 201, and then when the substrate 146 is returned upward, the transferred glue part 145 in the pressing transfer area T is to be transferred to a sheet serving as the transferred surface 201. Further, the substrate 146 is slid in a direction indicated by an arrow 202 in a state in which the transferred glue part 145 is pressed against the transferred surface 201, and then when the substrate 146 is returned upward, the transferred glue part 145 having a sliding length of the substrate 146 is to be transferred to the transferred surface 201.

In the present embodiment, the substrate 146 is arranged inside an exterior case 203 to be capable of moving in the vertical direction. In FIG. 3, a spring member 204 is arranged to energize the substrate 146 downward against the exterior case 203. A first gear G1 is coaxially fixed on the winding reel 143, and a second gear G2 is coaxially fixed on the feed reel 142. The first gear G1 and the second gear G2 are engaged with each other. Thus, if the adhesive tape 141 is pulled in a winding direction thereof, the first gear G1 is rotated anticlockwise, and the winding reel 143 is rotated clockwise together with the second gear G2, as a result, the adhesive tape 141 is wound on the winding reel 143.

A third gear G3 is arranged on the winding reel 143 through a one-way clutch mechanism (not shown) coaxially with the first gear G1. A rack gear G4 which is engaged with the third gear G3 is arranged on the inner side of the case 203.

If the third gear G3 is rotated clockwise, the one-way clutch connects the third gear G3 with the winding reel 143, and in this way, the winding reel 143 winds the adhesive tape 141 with the rotation force of the third gear G3.

On the contrary, if the winding reel 143 is rotated clockwise, the one-way clutch releases the connection of the third gear G3 with the winding reel 143, and then only the winding reel 143 rotates in the winding direction.

If the substrate 146 is pressed downward by the spring force of the spring member 204 against the exterior case 203, the third gear G3 is rotated clockwise through the engagement with the rack gear G4, and the adhesive tape 141 is wound on the winding reel 143. That is, during the period when the exterior case 203 is being moved upward after the base material 145 is transferred, in synchronization with the pressing of the substrate 146 downward by the spring force of the spring member 204, the adhesive tape 141 is wound on the winding reel 143 in a given amount.

Further, when the glue material supply section 14 is slid in the direction indicated by the arrow 202 to adhere glue, even if the rotation force in the winding direction is applied to the winding reel 143, it is also guaranteed that the winding reel 143 can be rotated freely because the winding reel 143 is in a non-connected state with the third gear G3 through the action of the one-way clutch.

The arrangement position of the glue material supply section 14 is described as a one-side standard in which the one side of the sheet width direction of the placement position of the sheet to be placed on the processing tray 2 where the sheet is guided by the guide member 3 is taken as the standard. A glue adhering section G (refer to FIG. 4-FIG. 10) is set at the corner part of the rear end of the sheet S at the one side to be the standard. In this way, regardless of the sheet size of the sheet S, it is possible to adhere glue without moving the glue material supply section 14 in the width direction. Further, by moving the glue material supply section 14 in the width direction, it is possible to set a plurality of positions in the width direction of the sheet S to be the glue adhering section G.

Figure 4:
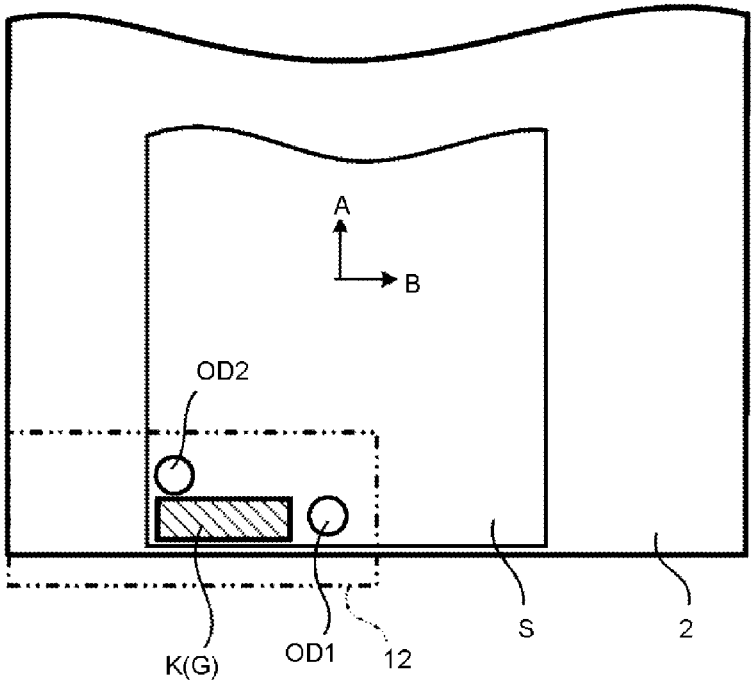
FIG. 4 is a plan view illustrating the constitution of a sheet detection section according to a first embodiment.
Figure 5:
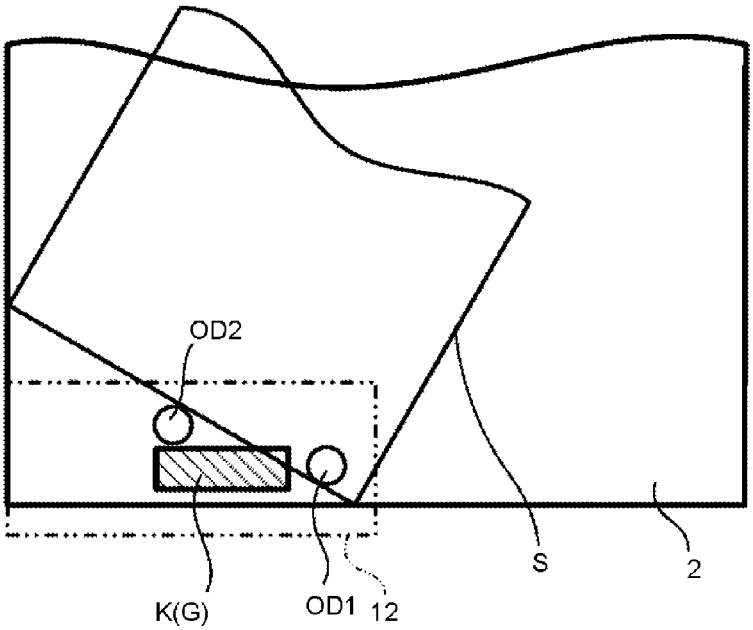
FIG. 5 is a diagram illustrating a case in which the first sheet shown in FIG. 4 isn't placed on a processing tray correctly.

FIG. 4 is a plan view illustrating the constitution of a sheet detection section according to a first embodiment, and FIG. 5 is a diagram illustrating a case in which the first sheet shown in FIG. 4 isn't placed on a processing tray correctly.

In FIG. 4, the glue adhering section G to be set in the binding margin of the sheet S is positioned at the corner part of one side in the width direction and at the rear side of the sheet S. Further, the "binding margin" mentioned herein means an area of sheet where glue is adhered through the glue material supply section 14. The sheet detection section includes an optical reflection-type first sheet detection sensor OD1 and an optical reflection-type second sheet detection sensor OD2. In the cradle 12 and the processing tray 2, holes (not shown) are formed through which the light of the first sheet detection sensor OD1 and the second sheet detection sensor OD2 can reach the sheet S. Herein, a direction B orthogonal to the sheet discharge direction A of the sheet S is set to the sheet width direction.

The first sheet detection sensor OD1 is arranged in the width direction nearby an assumed glue adhering section K that is assumed to be adhered with glue material through the glue material supply section 14. As shown in FIG. 4, if the first sheet S placed on the processing tray 2 is placed at a correct position in both the discharge direction and the width direction, the first sheet detection sensor OD1 detects (ON) that the rear end of the sheet S is positioned at the position of the assumed glue adhering section K.

Thus, when the first sheet detection sensor OD1 outputs an ON signal, it can be determined that the first sheet S is placed at the correct gluing position of the processing tray 2.

In the present embodiment, the second sheet detection sensor OD2 is arranged at the downstream side in the sheet discharge direction with respect to the assumed glue adhering section K and nearby the assumed glue adhering section K. As shown in FIG. 4, if the first sheet S is placed at the correction position of the processing tray 2, the second sheet detection sensor OD2 also outputs an ON signal. On the contrary, as shown in FIG. 5, if the sheet S is skewed or a folded corner occurs due to the jam of the sheet S, the sheet S cannot be detected by the second sheet detection sensor OD2, and the second sheet detection sensor OD2 outputs an OFF signal. In this case, the sheet S can be detected by the first sheet detection sensor OD1.

That is, in a case in which the second sheet detection sensor OD2 outputs an OFF signal even if the first sheet detection sensor OD1 outputs an ON signal, it can be determined that the first sheet S isn't positioned at the correct position of the processing tray 2.

In the case shown in FIG. 4, the first sheet detection sensor OD1 outputs the ON signal, and therefore, the glue can be adhered to the glue adhering section G of the first sheet S through the glue material supply section 14. Of course, if the determination on the ON signal of the second sheet detection sensor OD2 is added, it can be determined with high accuracy that the first sheet S is placed at the correct position of the processing tray 2.

In the case shown in FIG. 5, by adding the determination on the detection signal of the second sheet detection sensor OD2, it can be indeed determined that the first sheet S isn't positioned at the correct position of the processing tray 2.

Figure 6:
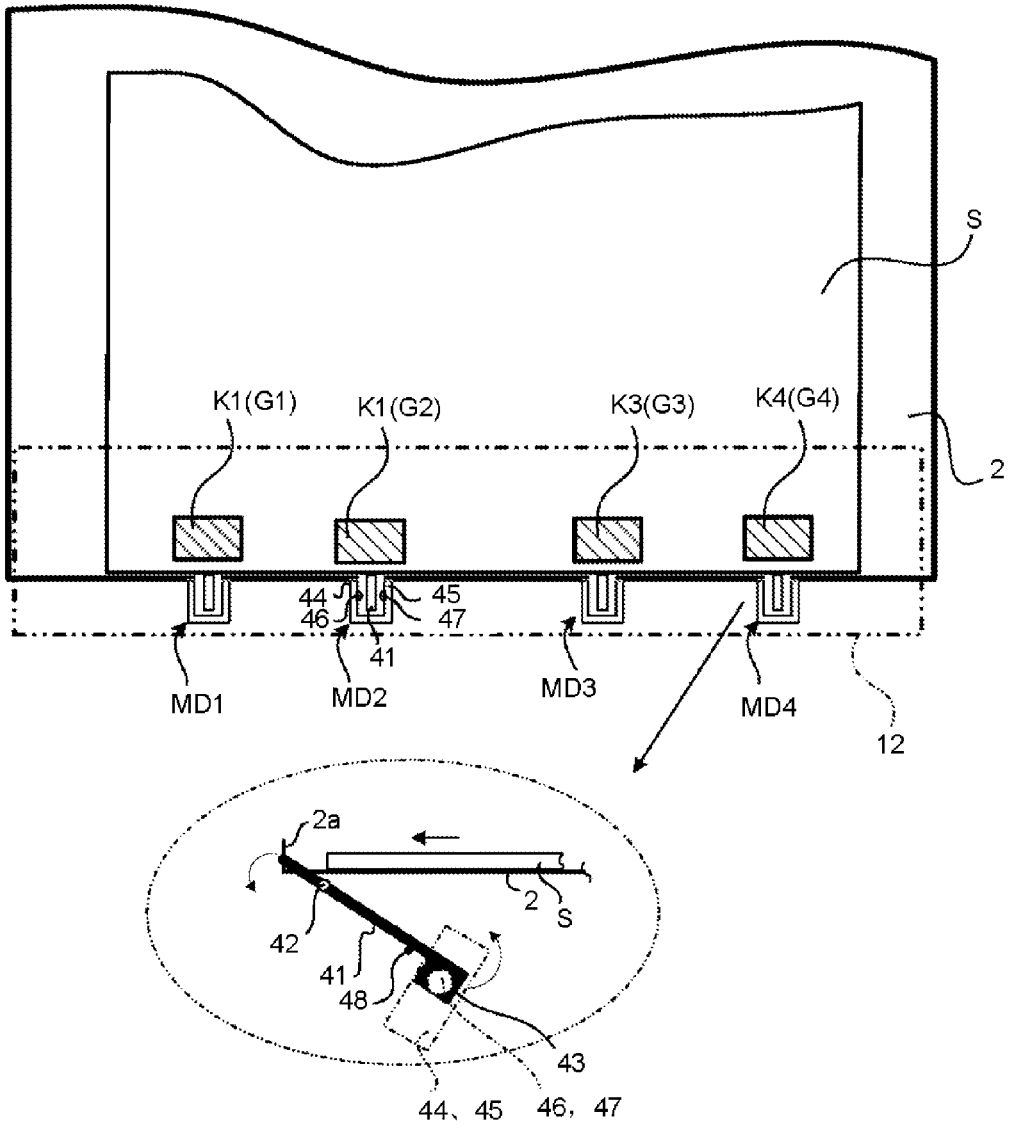
FIG. 6 is a plan view illustrating the constitution of a sheet detection section corresponding to various sizes of the first sheet to be placed on the processing tray according to a second embodiment.

FIG. 6 is a plan view illustrating the constitution of a sheet detection section corresponding to various sizes of the first sheet to be placed on the processing tray according to a second embodiment.

The sheet detection section according to the present embodiment is a mechanical sheet detection sensor MD (MD1-MD4) that is arranged in the width direction to be corresponded to the assumed glue adhering section K (K1-K4).

As shown in the enlarged diagram, the sheet detection sensor MD is provided with a light shielding section 43 at the rear end of a detection lever 41 that swings by taking a fulcrum pin 42 as the fulcrum. The front end of the detection lever 41 protrudes only slightly from the upper surface of the processing tray 2. Such a state can be maintained by, for example, contacting the detection lever 41 with a stopper 48. At both sides of the light shielding section 43, a holding section 44 for holding a light projecting element 46 and a holding section 45 for holding a light receiving element 47 are arranged. When the rear end of the sheet S is fed in the front end direction of the detection lever 41, the front end of the detection lever 41 is pressed, the detection lever 41 swings in the arrow direction, and then the light shielding section 43 moves. Through the movement of the light shielding section 43, a light path between the light projecting element 46 and the light receiving element 47 is opened, and the light receiving element 47 receives the light of the light projecting element 46 to output an ON signal. The sheet S that pressed the front end of the detection lever 41 reaches a positioning section 2*a* of the processing tray 2 or stops just before the positioning section 2*a* of the processing tray 2.

In a case in which the mechanical sheet detection sensor MD outputs the ON signal, the rear end position of the sheet S can be detected with a very high accuracy. Even in a case of glue binding, it is preferred to carry out glue binding at a position close to the corner part of the sheet S as much as possible, similar to the case of staple binding. Thus, by detecting the rear end position of the sheet S with high accuracy, it is possible for the glue adhering section G to close to the rear end of the sheet S as much as possible.

On the other hand, in a case in which the placement standard of sheet on the processing tray 2 is set to the center of the width direction, a first sheet detection sensor MD1 and a fourth sheet detection sensor MD4 are set to a first group, and a second sheet detection sensor MD2 and a third sheet detection sensor MD3 are set to a second group. Both the first group and the second group include a pair of sheet detection sensors at separated positions in the width direction. Thus, only in the case in which the sheet detection sensors of the two groups output ON signals, it is determined that the sheet S is placed at the correct position of the processing tray 2. Either or both of the sheet detection sensors of the two groups output OFF signals, it can be determined that the sheet S is placed in a state like shown in FIG. 5.

Figure 7:
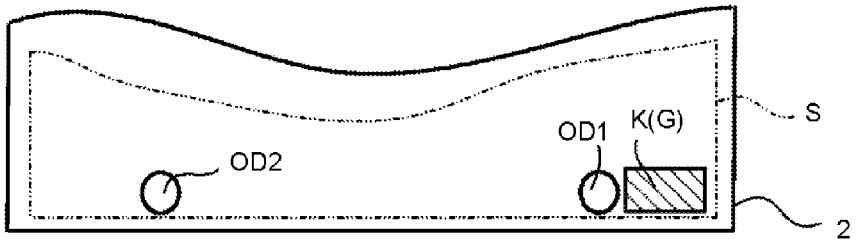
FIG. 7 is a plan view illustrating an arrangement relation between a sheet detection section and a gluing adhering section of a sheet according to a third embodiment.

The embodiment shown in FIG. 7 is a modification of the embodiment shown in FIG. 4, and in which an optical reflection-type second sheet detection sensor OD2 is arranged to be separated from an optical reflection-type first sheet detection sensor OD1 in the width direction. In this case, similar to the embodiment shown in FIG. 6, only in the case where both the first sheet detection sensor OD1 and the second sheet detection sensor OD2 that are paired with each other in the width direction output ON signals, it is also determined that the sheet S is placed at the correct position of the processing tray 2.

Figure 8:
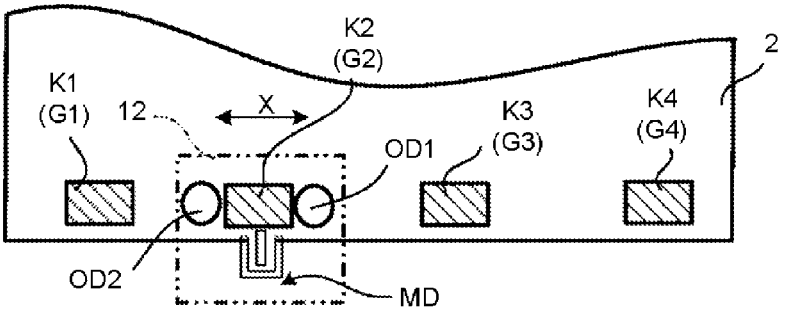
FIG. 8 is a plan view illustrating an arrangement relation between a sheet detection section and a gluing adhering section of a sheet according to a fourth embodiment.

In the embodiment shown in FIG. 8, the cradle 12 is capable of moving in the width direction indicated by an arrow X. An optical reflection-type first sheet detection sensor OD1 and an optical reflection-type second sheet detection sensor OD2 are arranged in the cradle 12 corresponding to the vicinity of both sides in the width direction of the assumed glue adhering section K. Further, a mechanical sheet detection sensor MD is arranged in the cradle 12 (arrangement position is similar to that in the embodiment shown in FIG. 6).

By moving such a movable type sheet detection sensor to the assumed glue adhering section K (K1-K4), it can be determined whether or not the sheet S is placed at the correct position of the processing tray 2 according to the size of the sheet S. Especially, when the glue adhering section G is set at the corner part of the sheet S, even if it is arranged nearby the both sides of the assumed glue adhering section K, it is possible to determine whether or not the sheet S shown in FIG. 5 is placed at the correct position.

Figure 9:
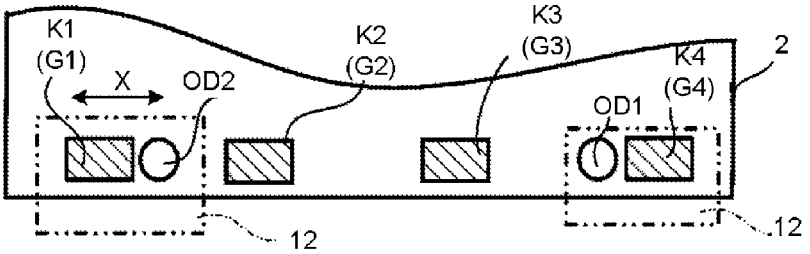
FIG. 9 is a plan view illustrating an arrangement relation between a sheet detection section and a gluing adhering section of a sheet according to a fifth embodiment.

The embodiment shown in FIG. 9 is a modification of the embodiment shown in FIG. 8.

In FIG. 9, an optical reflection-type first sheet detection sensor OD1 is fixedly arranged nearby the inner part in the width direction of the fourth assumed glue adhering section K4. An optical reflection-type second sheet detection sensor OD2 is arranged in the cradle 12 which is capable of moving in the width direction. The second sheet detection sensor OD2 moves in the width direction indicated by the arrow X according to the size of the sheet S.

In this case, only in the case where both the first sheet detection sensor OD1 and the second sheet detection sensor OD2 output ON signals, it is determined that the sheet S is placed at the correct position of the processing tray 2.

Figure 10:
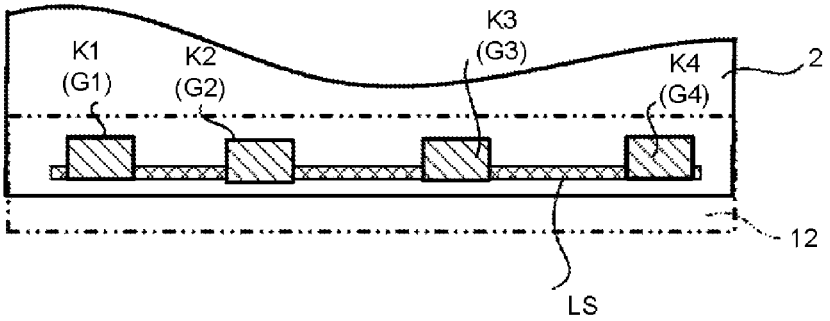
FIG. 10 is a plan view illustrating an arrangement relation between a sheet detection section and a gluing adhering section of a sheet according to a sixth embodiment.

In the embodiment shown in FIG. 10, a line sensor LS is arranged to be over the entire width in the width direction of the processing tray 2. The line sensor LS is arranged at the rear end side of the sheet S.

On the processing tray 2, the sheet S is placed by taking, for example, a first glue adhering section G1 as the one-side standard. The line sensor LS detects whether or not there is a sheet S within a length corresponding to the sheet size in the width direction (equivalent to the second sheet detection sensor) by taking the first assumed glue adhering section K1 as the standard (equivalent to the first sheet detection sensor). Further, the line sensor LS can detect the rear end position of the sheet S.

Thus, only in the case in which the line sensor LS outputs ON signals at both the standard position and the other point position to be set corresponding to the sheet size, it is determined that the sheet S is placed at the correct position of the processing tray 2. Further, if the rear end position of the sheet S is deviated from a given position, it can be also determined that there is no sheet.

Figure 11:
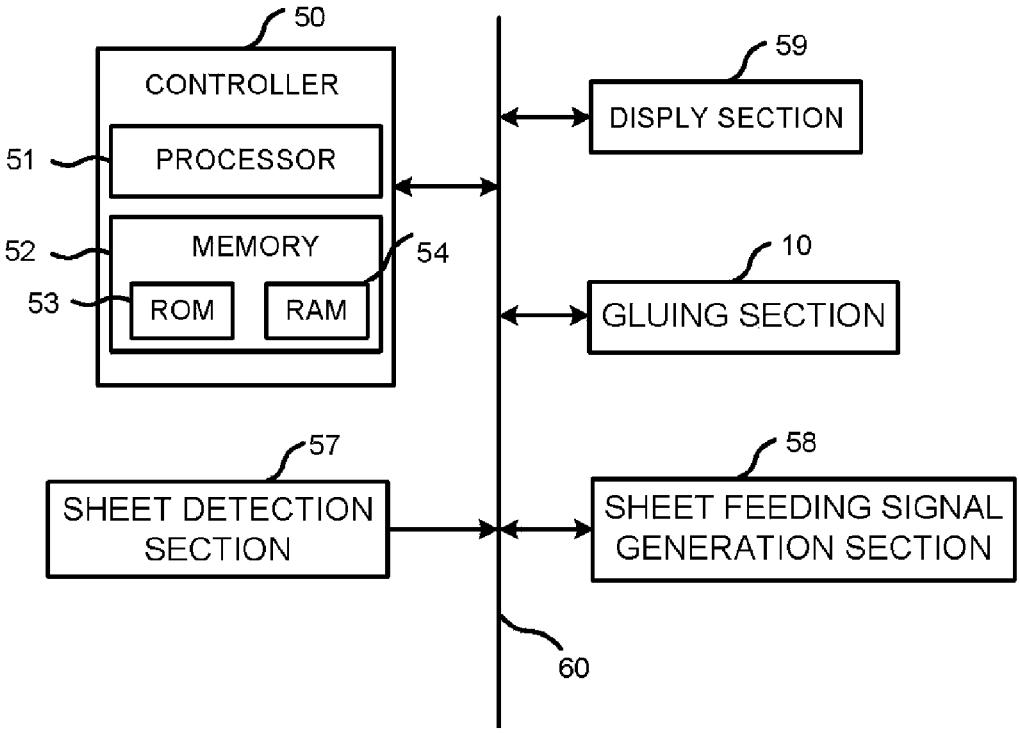
FIG. 11 is a control block diagram illustrating the glue binding processing apparatus according to the embodiment.

FIG. 11 is a control block diagram of the sheet glue binding processing apparatus.

A sheet glue binding processing apparatus 1 comprises a controller 50, a sheet detection section 57, the gluing section 10, a display section 59 and a sheet feeding signal generation section 58 of the image forming apparatus, which are connected with each other via a bus line 60.

On the display section 59, a determination result on whether or not the first sheet S is correctly placed on the processing tray 2 is displayed, and a warning is displayed if it is determined that the first sheet S is placed unsuitably.

The controller 50 is provided with a processor 51 including a CPU (Central Processing Unit) or an MPU (Micro Processing Unit) and a memory 52.

The sheet feeding signal generation section 58 outputs, when the first sheet is to be sent to the sheet post processing apparatus after the printing of the first sheet is ended by the image forming apparatus, a sheet feeding signal to the controller 50. When acquiring the sheet feeding signal, the controller 50 carries out a placement determination processing on whether or not the first sheet is correctly placed on the processing tray 2.

The memory 52, which is, for example, a semiconductor memory, includes a ROM (Read Only Memory) 53 for storing various kinds of control programs and a RAM (Random Access Memory) 54 for providing a temporary work area to the processor 51. For example, the ROM 53 stores the program for executing the placement determination processing.

The sheet detection section 57 may use the optical reflection-type sheet detection sensor shown in FIG. 4, FIG. 5 and the like, the mechanical sheet detection sensor shown in FIG. 6 and the like, the line sensor shown in FIG. 10, and the like.

The processor 51 carries out a determination on whether to carry out a gluing process for the first sheet based on the sheet presence/absence signal detected by the sheet detection section 57, and determines to drive or to stop driving the gluing section 10 according to the determination result.

Figure 12:
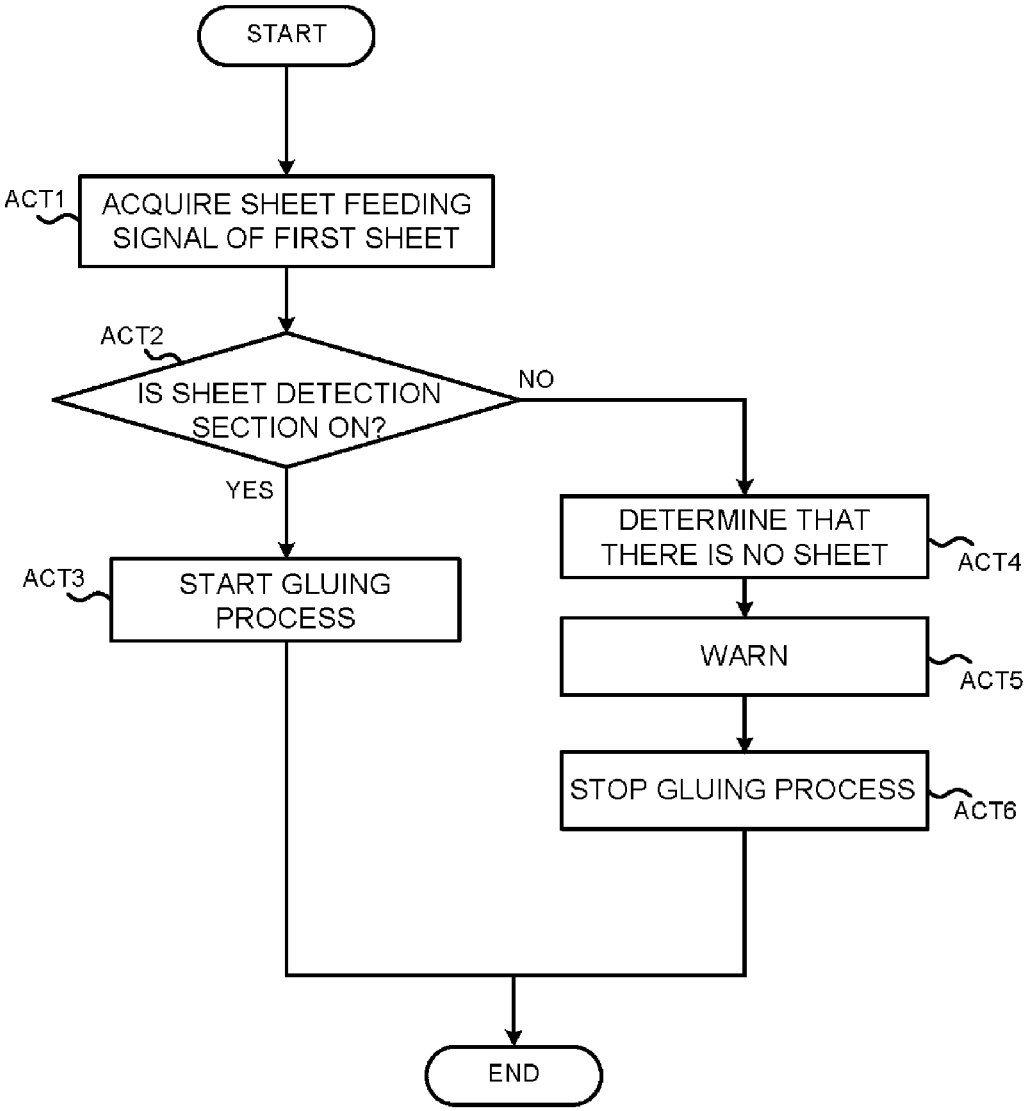
FIG. 12 is a flowchart illustrating the flow of a first placement determination processing.

FIG. 12 is a flowchart illustrating the flow of a first placement determination processing on determining whether or not the first sheet S is correctly placed on the processing tray 2 based on the control of the processor 51, and is described with reference to FIG. 3 and FIG. 4.

In ACT 1, a sheet feeding signal of the first sheet is acquired, and then ACT 2 is taken.

In ACT 2, it is determined whether or not the output of the sheet detection section 57 (first sheet detection sensor OD1) is ON. The sheet detection section 57 detects whether or not the rear end in the sheet discharge direction of the sheet S on the processing tray 2 reaches the glue adhering section G.

If the sheet detection section 57 outputs a detection signal (ON) indicating that the sheet S is detected (YES in ACT 2), ACT 3 is taken. While if the sheet detection section 57 doesn't detect the sheet S (NO in ACT 2), ACT 4 is taken.

In ACT 3, the gluing section 10 is instructed to execute the gluing process for the first sheet, and then the processing is ended.

In ACT 4, it is determined that there is no sheet, and then ACT 5 is taken.

In ACT 5, a warning is displayed on the display section 59 since the first sheet doesn't reach the processing tray 2, or the first sheet isn't placed at the correct position, and then ACT 6 is taken.

In ACT 6, the gluing section 10 is instructed to stop the gluing process, and then the processing is ended.

Figure 13:
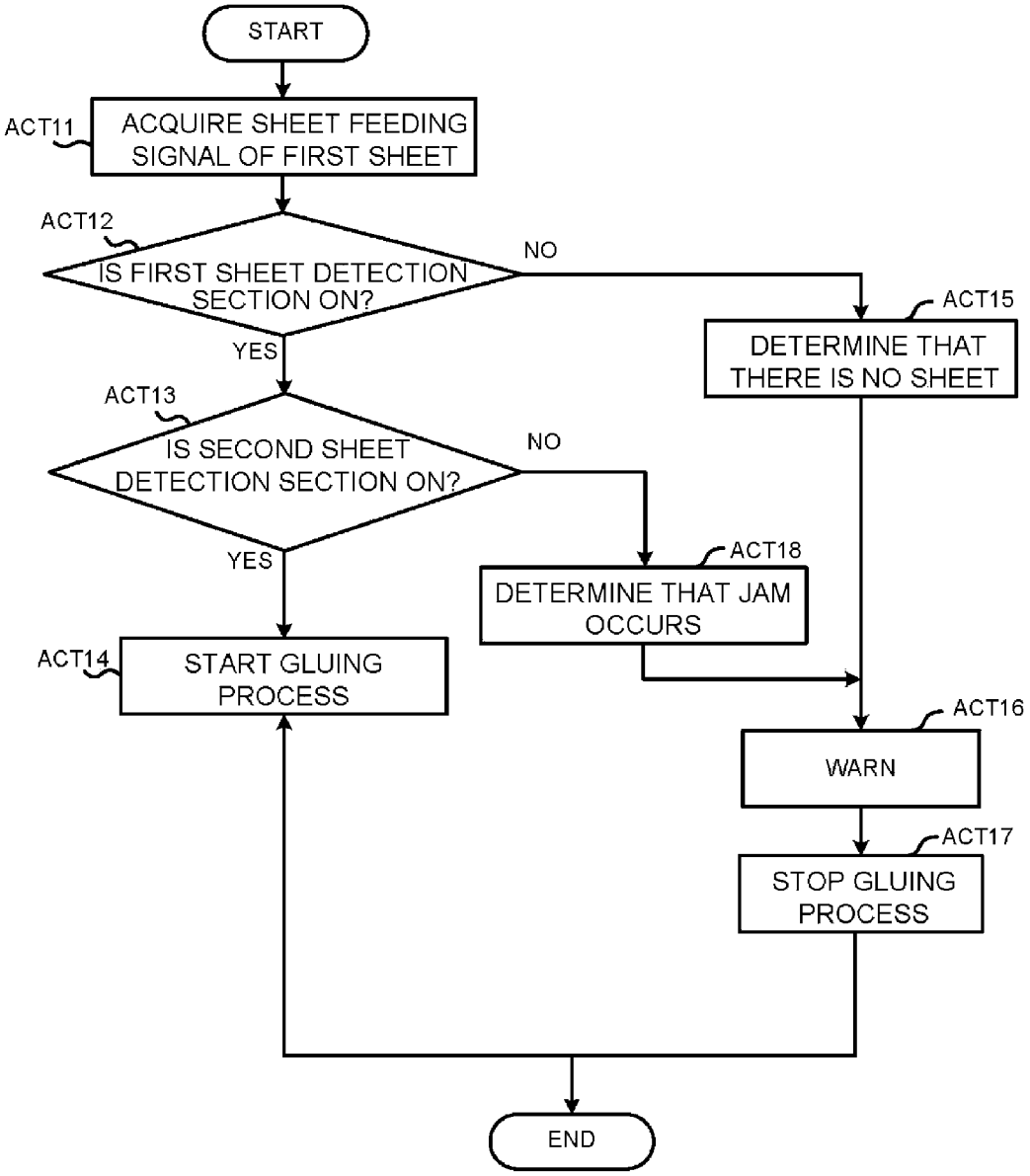
FIG. 13 is a flowchart illustrating the flow of a second placement determination processing.

FIG. 13 is a flowchart illustrating the flow of a second placement determination processing on determining whether or not the first sheet S is correctly placed on the processing tray 2 based on the control of the processor 51, and is described with reference to FIG. 3 and FIG. 4.

In ACT 11, a sheet feeding signal of the first sheet is acquired, and then ACT 12 is taken.

In ACT 12, it is determined whether or not the output of the first sheet detection section (first sheet detection sensor OD1) is ON, ACT 13 is taken if the first sheet detection section outputs an ON signal indicating that the sheet is detected (YES in ACT 12), and ACT 15 is taken if the first sheet detection section doesn't detect a sheet (NO in ACT 12) and outputs an OFF signal. The first sheet detection section detects, for example, whether or not the rear end of the sheet S (in other words, the sheet end portion positioned at the upstream side in the sheet discharge direction of the processing tray 2) reaches the glue adhering section G. Further, the glue material supply section 14 of the gluing section 10 is arranged above the glue adhering section G in the vertical direction.

In ACT 13, it is determined whether or not the output of the second sheet detection section (second sheet detection sensor OD2) is ON, ACT 14 is taken if the second sheet detection section outputs an ON signal indicating that the sheet is detected (YES in ACT 13), and ACT 18 is taken if the second sheet detection section doesn't detect a sheet (NO in ACT 13) and outputs an OFF signal. The second sheet detection section may be configured at the sheet discharge side different from the position of the first sheet detection section in the sheet discharge direction of the sheet S, or configured at a position separated from the first sheet detection section in the sheet width direction to detect the rear end of the sheet.

In ACT 14, the gluing section 10 is instructed to execute the gluing process for the first sheet, and then the processing is ended.

In ACT 15, it is determined that there is no sheet, and then ACT 16 is taken.

In ACT 16, a warning is displayed on the display section 59 since the first sheet doesn't reach the processing tray 2, or the first sheet isn't placed at the correct position, and then ACT 17 is taken.

In ACT 17, the gluing section 10 is instructed to stop the gluing process, and then the processing is ended.

In ACT 18, it is determined that a jam and the like of the sheet S occur on the processing tray 2 and the like, and then ACT 16 is taken.

As described above, according to the embodiments, that the glue is adhered to the cradle will not happen because the gluing process is not carried out in a state in which there is no the first sheet in the cradle. Thus, it is possible to prevent a sheet from being stuck to the cradle and prevent the occurrence of jam due to the sticking of the sheets following the second-sheet to the cradle.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A sheet glue binding processing apparatus, comprising:

a processing tray configured to be used to stack a sheet in such a manner that one end of the sheet is fed in a first direction to a positioning section, a binding margin is located on the one end;

a glue binding section configured to adhere glue material to the binding margin of an upper surface of a top sheet stacked on the processing tray whenever the sheet is discharged to the processing tray, wherein upon glue binding a bundle of N sheets the glue binding section is configured to adhere glue material to N−1 sheets, and N is an integer;

a first sensor configured to detect whether or not the sheet is in a first position, the first sensor positioned adjacent to a glue adhering position in a second direction, the glue adhering position set on the top sheet, and the second direction orthogonal to the first direction; and a second sensor configured to detect whether or not the sheet is in a second position, the second sensor positioned adjacent to the glue adhering position in the first direction.

2. The sheet glue binding processing apparatus according to claim 1, further comprising:

a control section configured to determine, based on a first signal of the first sensor and a second signal of the second sensor, whether or not the glue binding section is driven to adhere glue to respective sheets of the N−1 sheets.

3. The sheet glue binding processing apparatus according to claim 1, wherein the glue binding section is provided with a glue material supply section including the glue material to be adhered to the binding margin of the sheet and a cradle configured at a position facing the glue material supply section to support the sheet.

4. The sheet glue binding processing apparatus according to claim 1, wherein the second sensor is at a second location different from a first location of the first sensor in the first direction.

5. The sheet glue binding processing apparatus according to claim 4, further comprising:

a control section configured to control the glue binding section so as to drive to adhere glue to the sheet when both the first sensor and the second sensor detect the sheet, and control the glue binding section so as not to drive when either the first sensor or the second sensor does not detect the sheet.

6. The sheet glue binding processing apparatus according to claim 5, wherein when the first sensor and the second sensor do not detect the sheet, the control section is configured to determine that the sheet is not on the processing tray, and when either one of the first sensor and the second sensor does not detect the sheet, the control section determine that a jam is occur.

7. The sheet glue binding processing apparatus according to claim 1, wherein the second sensor is at a location separated from the first sensor in the second direction.

8. The sheet glue binding processing apparatus according to claim 7, wherein the glue binding section is provided with a glue material supply section including the glue material to be adhered to the binding margin of the sheet, a cradle arranged to be opposite to the glue material supply section across the sheet to support the sheet, and the second sensor; wherein, the cradle and the second sensor are integrated to be capable of moving in the second direction.

9. The sheet glue binding processing apparatus according to claim 1, wherein the first sensor is configured to detect the one end position of the sheet to be fed to the positioning section.

* * * * *